US007992299B2

(12) United States Patent
Glatz et al.

(10) Patent No.: US 7,992,299 B2
(45) Date of Patent: Aug. 9, 2011

(54) METHOD FOR THE ECONOMICAL PRODUCTION OF HEAT EXCHANGER TUBES BENT IN A U-SHAPE

(75) Inventors: Horst Glatz, Neu-Ulm (DE); Eberhard Lepin, Illertissen (DE); Gerhard Schuez, Voehringen (DE); Martin Straub, Illertissen (DE)

(73) Assignee: Wieland-Werke AG, Ulm (DE)

( * ) Notice: Subject to any disclaimer, the term of this patent is extended or adjusted under 35 U.S.C. 154(b) by 1227 days.

(21) Appl. No.: 10/539,955

(22) PCT Filed: Oct. 30, 2003

(86) PCT No.: PCT/EP03/12050

§ 371 (c)(1),
(2), (4) Date: Jun. 17, 2005

(87) PCT Pub. No.: WO2004/056502

PCT Pub. Date: Jul. 8, 2004

(65) Prior Publication Data

US 2006/0096346 A1 May 11, 2006

(30) Foreign Application Priority Data

Dec. 21, 2002 (DE) ..... 102 60 399

(51) Int. Cl.
*B21D 21/00* (2006.01)
*B23P 15/26* (2006.01)

(52) U.S. Cl. ..... 29/890.053; 29/890.03; 29/417; 72/68; 72/289

(58) Field of Classification Search ..... 29/417, 29/890.053, 890.03; 72/68, 289
See application file for complete search history.

(56) References Cited

U.S. PATENT DOCUMENTS 3,568,488 A * 3/1971 Franks ..... 72/68
3,934,449 A * 1/1976 Uhlmann et al. ..... 72/289
4,393,566 A * 7/1983 Uhlmann et al. ..... 29/417

FOREIGN PATENT DOCUMENTS

DE 2928084 A1 1/1981
EP 0644272 A2 3/1995
EP 0648855 A1 4/1995
EP 1 232 808 A2 8/2002

OTHER PUBLICATIONS

International Search Report dated Feb. 10, 2004 (6 pages).

* cited by examiner

*Primary Examiner* — Rick K Chang
(74) *Attorney, Agent, or Firm* — Flynn, Thiel, Boutell, Tanis, P.C.

(57) ABSTRACT

The invention relates to a method for the manufacture of tubes bent in a U-shape (hairpin tubes) from a nonferrous metal, immediately following a tube production line. For that purpose, according to the invention, the method for the manufacture of tubes bent in a U-shape from a nonferrous metal, immediately following a tube production line, has the consecutive steps of:

a) uncoiling the drawn tube material from a basket winder,
b) straightening the drawn tube material,
c) annealing and subsequently cooling the drawn tube material before or after cutting, for separation into tube portions, to the starting length for a tube bent in a U-shape, and
d) bending the tube portions into a U-shape.

5 Claims, 6 Drawing Sheets

METHOD FOR THE ECONOMICAL PRODUCTION OF HEAT EXCHANGER TUBES BENT IN A U-SHAPE

BACKGROUND OF THE INVENTION

The invention relates to a method for the manufacture of tubes bent in a U-shape from a nonferrous metal, immediately following a tube production line. The invention also relates to a production line for the manufacture of tubes bent in a U-shape.

Cold air has to be provided for the air-conditioning of buildings and the generation of low temperatures in the industrial sector (for example, cold-storage rooms, warehouses). Cyclic processes are generally used for this purpose. A distinction is made between compression processes and absorption processes. Lamellar heat exchangers in which air is cooled by a cold heat carrier or by a directly evaporating refrigerant are used to generate cold air. In air-cooled refrigerating/air-conditioning systems, the waste heat occurring in a condenser or a re-cooling plant is conveyed away to the atmospheric air. Both types of heat exchangers are typically in the form of lamellar apparatuses which comprise stacks of lamellae fitted on copper tubes.

Depending on the thermo-hydraulic requirements, the lamellar apparatuses are constructed with one or more tube passes. Whereas straight tubes are generally used in apparatuses having one pass, the refrigerant stream or heat carrier stream has to be reversed in multi-pass constructions and conveyed back through the apparatus. These reversals of direction can be effected by fittings (bends) attached to the tube ends or by tubes bent in a U-shape. This last-mentioned solution is very inexpensive and therefore the industrially advantageous solution.

In order to manufacture the lamella stacks, the thin-walled tubes, which are generally obtained in coiled form and which have a wall thickness of only a few tenths of a millimeter, are uncoiled by the heat exchanger manufacturer, cut to a desired length and bent to form U-shaped tubes ("hairpins").

Bending machines for U-shaped tubes permit the simultaneous bending of up to eight hairpins (or more) at the same time. However, in the case of multiple-bending machines, the entire bending line comes to a standstill when a coil runs out. The exhausted coil must then be replaced by a fresh one. Large coil weights lead to fewer stops but are substantially more demanding in terms of handling during transport and coil changes. Many uncoiling devices are not designed for relatively large coil weights. In order to avoid frequent coil changes, apparatus manufacturers stipulate minimum coil weights. Underweight coils, which occur at the tube manufacturer's as a result of the manufacturing process, are often not saleable and have to be scrapped.

During the uncoiling process the tubes are alternately accelerated and braked. During that operation, the thin-walled tubes are susceptible to buckling. In the case of uncoiling devices that are not braked, loops are sometimes formed which may cause the coiled layers to become "unraveled". After a few rotations, this may result in the overlapping of the layers with snarling and finally in the tube breaking.

In addition, the manufacture of tubes from copper and copper alloys for the areas of application to be considered here, as domestic plumbing tubes and especially as heat exchanger tubes for air-conditioning and refrigeration engineering, is known.

For example, starting from cylindrical slabs or billets cast by the ingot-casting method or by the continuous-casting method, the extrusion of tubes and the hot-rolling of tube blanks are applied as the currently normal method of hot-forming for large reductions in cross-section. In the subsequent production step, cold-forming methods, such as slide drawing with slide drawing machines or ball block machines, or tube-rolling techniques, such as cold pilger rolling, are used.

With the planetary diagonal rolling process, a reduction in cross-section of the tube wall of more than 90% is achieved in one pass by means of a continuously running tube-rolling process. The resultant frictional heat in the forming region leads to a heating of the material up to the recrystallisation range of copper. Such a temperature treatment has a direct effect on the softness of the material in order to ensure adequate deformability for the subsequent cold-drawing steps. In order to at least partially suppress the enormous increase in temperature, printed specification EP 1 232 808 A2 proposes a cooling device for the cold-rolling operation.

Printed specification EP 0 648 855 A1 describes, for example, a method for the manufacture of seamless tubes from copper and copper alloys, in which method a special role is played by targeted recrystallisation processes in relation to deformability. The method also describes the usual handling of semi-finished tubes which are wound into a coil after a forming process. A feature of present-day practice in the production of heat exchanger tubes from copper and copper alloys is that the final form is wound predominantly into multi-turn coils having narrow coil radii and a limited weight and is delivered in the bright-annealed soft state in order to be unwound again at another site, straightened and cut to length and further processed to form, for example, tubes bent in the shape of a hairpin for lamellar heat exchangers.

This hitherto conventional net product chain from tube manufacture through the production of heat exchangers to the installation of complete refrigerating/air-conditioning systems, has grown historically. It is based on the fact that tubes are common semi-finished products which are manufactured by the semi-finishing industry and delivered to the apparatus manufacturers. Since tube manufacturers and apparatus constructors are often far apart geographically, the shipment of coiled tubes, which require only a small amount of transport volume, has developed.

It is precisely the tight winding of the tube coils which creates fundamental problems in the handling of the material. In the case of conventional dimensions of the wound coils with a diameter of 0.6 m and a maximum outside coil diameter of approximately double that figure, the tubes, after the bend-straightening operations which have taken place on removal from the basket and conveyance into the coiler, with expansions and compressions of 1-3%, which are a function of the outside tube diameter, are subjected to fresh forming under bending conditions. The bend-straightening, carried out under longitudinal tensile stresses, to return to a straight tube again, result in a reduction in its average outside diameter, and the deflection onto the winder results in a reduction in wall thickness in the outer expansion region and to an increase in wall thickness in the inner compression region and in a flattening and ovalisation of its cross-section. Because the coil weights constitute, in a limited manner, only approximately one quarter to a maximum of approximately half the total weight of the tube conductor length deposited in the basket, considerable tube waste often also occurs.

In addition, the softening and recrystallisation which occur during the bright-annealing of the highly hardened heat exchanger tubes, which are in the form of tightly wound coils, lead to an adaptation of the tube cross-sections to the geometrical constrained conditions of the coil and therefore to changes in the shape of the tube cross-section and in the layer diameters of individual turns, especially the outer turns.

Further disadvantages of the hairpin production of tightly coiled and soft tubes are surface damage, jamming turns, which result in buckling, and the occurrence of a large amount of scrap owing to unusable tube ends at the beginning and the end of the coil.

SUMMARY OF THE INVENTION

The object of the invention is therefore to provide a method which eliminates the mentioned disadvantages of cross-sectional deformation and changes in diameter and wall thickness in the case of heat exchanger tubes and to provide an apparatus for the manufacture of heat exchanger tubes.

With regard to the method for the manufacture of tubes bent in a U-shape from a nonferrous metal, immediately following a tube production line, the problem is solved by the consecutive steps of:

a) uncoiling the drawn tube material from a storage device, b) straightening the drawn tube material, c) annealing and subsequently cooling the drawn tube material before or after cutting, for separation into tube portions, to the starting length for a tube bent in a U-shape, d) bending the tube portions into a U-shape.

The invention is based on the consideration that a tube-drawing operation should be immediately followed by an economical method for the production of hairpin tubes. For this purpose, the expenditure on the transport and handling of the coiled and relatively sensitive semi-finished production should be kept as low as possible. Furthermore, the losses in quality caused by uncoiling and bending problems, and the resulting complaints on the part of apparatus manufacturers of heat exchangers should be reduced in order to achieve greater customer satisfaction. In order to ensure that the described production steps can be carried out as smoothly as possible by the manufacturers of lamellar heat exchangers, the tubes should satisfy the narrow technical specifications with regard to dimensions, eccentricity, mechanical parameters and surface state. Occasionally, in addition to the standards, apparatus manufacturers explicitly require that the tubes must be bendable and, in particular, expandable.

For that purpose, the method, with a production of tubes bent in a hairpin-shape for lamellar heat exchangers as the final production step, is shifted to the production of copper tubes. As a result, the otherwise usual semi-finished form of a "tightly wound coil" is avoided. The drawn tube material for heat exchanger tubes, which in the penultimate production step is deposited in the horizontal position in large round open-topped containers, is preferably conveyed directly from those so-called baskets by way of a straightening and testing section to an inductive continuous annealing furnace with a following cooling section and deposited in baskets again in the recrystallised state, using measures that take the "soft" state into account. Alternatively, the drawn tube material is separated directly in the form of stretched hairpin lengths and conveyed directly to the hairpin machine after a good/bad sorting operation. The further processing to form hairpin tubes that are bent in a U-shape and that have U-bend radii determined by the customer and parallel limb lengths takes place either with straight tube portions that have already been cut to the desired length or, however, directly from several baskets simultaneously, the number of which corresponds to that of the bending heads of the conventional industrial multiple hairpin bending machine, the soft tubes being straightened, cut to the desired length for separation and bent to form hairpins on this machine and deposited in stacked form in crates.

In a preferred embodiment, the drawn tube material or the tube portions are subjected to quality control, in particular, to a test for sealing, in one of steps a) to c). Eddy current testing by means of which extremely fine inhomogeneities on the outer tube surface can be reliably detected has proved its worth. The regions recognized to be defective are identified and removed. It is especially advantageous if the straightening of the drawn tube material in step b) is combined with the sealing test.

An important quality feature of the tubes is their internal cleanliness. While straight drawn tube material passes through the annealing region of a continuous furnace, in a preferred embodiment, the inside of the drawn tube material is flushed over its entire length with an inert gas, preferably with nitrogen or nitrogen/hydrogen. In the manufacture of copper tubes, the required small amount of residues of a residual carbon coating can be achieved by this annealing step by the use of special oils, in which step the oil vapours passing into a gaseous phase are transported out of the tubes without leaving residues. In particular, lubricant residues in the tubes can be removed in this manner and, thus, adverse interactions with the working substances of the refrigeration circuit, such as, for example, the decomposition of the refrigerant and corrosion damage are avoided.

Advantageously, the inert gas flows counter to the uncoiling direction of the drawn tube material in order to transport impurities out of the tube counter to the direction of manufacture. In the heated region of the annealing furnaces, the outside of the tube is additionally acted upon with an inert gas.

Advantageously, after cutting to a desired length for separation, the tube portions identified as being defective are sorted out after the quality control at as early a production stage as possible.

In many production process steps, the cleanliness of the tube surface may also be impaired by impurities which cannot be removed by an annealing process. In a preferred arrangement, after cutting to a desired length for separation, the tube portions are subjected to internal and/or external cleaning. Sawing or also chip-free separation come into consideration for the purpose of separation into tube portions. Residues must be removed by the cleaning step, especially in the case of machining.

The so-called bright-annealing operation which is preferably carried out under an inert gas atmosphere is used to subject the tubes to recrystallisation and to prepare them again in their "soft" state for forming under bending conditions. For that purpose, advantageously, either the drawn tube material is annealed in a continuous operation or the separated tube portions are annealed in a batch operation.

In a batch operation, the material is arranged, for example, on transport stands. The separated tube portions are conveyed to the cleaning apparatus and subsequently deposited in a storage unit. Annealing is effected in a batch operation in an annealing unit under an inert gas atmosphere before the soft tube portions are conveyed to the bending device. Metallically pure inner tube surfaces with permissibly ever smaller carbon residue values are a quality demand which is being made ever more frequently on heat exchanger tubes.

In a preferred embodiment, after straightening and before testing, the drawn tube material is subjected to a ribbing process. In that process, the rates of passage through the ribbing unit and through the annealing operation must be adapted to one another in terms of automatic control engineering.

With regard to economical production, production steps can also be optimized by the time-consuming steps operating in parallel. To that end, when the drawn tube material is annealed before being cut to a length for separation into tube portions, the drawn tube material is advantageously deposited in a basket winder and further processed in parallel in a single- or multiple-bending device. When depositing the soft-annealed tubes, which are susceptible to scratching and damage, special attention must be paid to a basket construction which is especially suitable for the purpose.

The problem is solved with regard to the apparatus by a production line for the manufacture of tubes bent in a U-shape from a non-ferrous metal, immediately following a tube production line, which comprises the following:

a) a storage device having an uncoiling device for a drawn tube material,
b) a straightening facility for the uncoiled drawn tube material and a testing facility,
c) an annealing unit and a following cooling unit for the drawn tube material before or after a cutting unit, for separation into tube portions, for cutting to the starting length or a multiple of the starting length for a tube bent in a U-shape,
d) a bending device for bending the tube portions into a U-shape The production line is composed of the apparatus equipment required to carry out the method for the manufacture of hairpins. The production line is a functional unit that overcomes the initially described disadvantages of tightly wound soft coils. It is not absolutely necessary to line up the individual apparatuses next to one another spatially in the manner of an assembly line but it is also possible to accept some transport distances, for example, in a factory, and to configure them so that the advantages taken as a basis by the solution according to the invention are nevertheless achieved.

In a preferred embodiment, an inert gas flushing unit is arranged at one end of the tube and a suction apparatus is arranged at the other end for the purpose of flushing the drawn tube material.

Complex production lines must nevertheless be speedily adaptable to various requirements. Advantageously, the cutting unit is for that purpose followed by a sorting apparatus for sorting different lengths of tube portions. As production continues, the respective lengths can then be finished on different bending machines, even in relatively small piece numbers, to form hairpins. Only with sufficient flexibility is it possible to satisfy customers' requirements.

A cleaning apparatus is advantageously arranged downstream of the cutting unit or optionally downstream of the sorting apparatus in order to subject the tube portions to internal and/or external cleaning.

In a preferred embodiment, the annealing unit for the drawn tube material in continuous operation or for the separated tube portions in a batch operation is an induction, radiation or convection furnace.

A further characteristic feature in terms of manufacturing engineering is advantageously a ribbing apparatus for the drawn tube material, which apparatus follows the straightening facility. The ribbed surface further increases the heat transfer of a tube.

The tubes bent in a U-shape are especially suitable for heat exchangers, especially lamellar heat exchangers. Depending on size, punched-out lamellae are for that purpose threaded onto the horizontally arranged hairpins or the hairpins are introduced into the stacks of lamellae lying horizontally. In order to connect the copper tubes to the lamellae, the tubes are expanded from inside to ensure as intimate a permanent contact as possible and also to ensure a low contact resistance. In the case of the expansion methods used at present, in which tubes are clamped at one end and expanded with a mandrel, the tubes contract if there is a constant weight per meter in the longitudinal direction. The free tube ends are then readily expanded in order to receive the fitting bends. Finally, the fitting bends are placed on the tubes and soldered manually or automatically. After the subsequent mounting of the distributing and manifold tubes, the apparatuses are subjected to a sealing test. Depending on the degree of production integration, these operating steps are carried out at uncoupled stations or entirely on a belt. Many manufacturers separate the manufacture of the tube bends from the production of the lamellar apparatuses.

The advantages achieved with the invention reside especially in the fact that the otherwise usual winding of the hardened heat exchanger tubes to form multi-layered narrow-radius coils that are limited in weight and the stack-wise annealing of those coils in a bright-annealing furnace are circumvented and therefore the disadvantages, known to experts, of tightly wound tubes, such as changes in cross-sectional shape in the form of ovalisation, wall thickness changes, inhomogeneous stress distribution and a large amount of waste lengths, are also prevented.

Furthermore, effective internal flushing of the heat exchanger tubes in conjunction with the inert gas atmosphere in the bright-annealing process ensures a relatively high degree of internal cleanliness.

Embodiments of the invention are explained in more detail with reference to schematic drawings.

DETAILED DESCRIPTION OF THE INVENTION

Parts that correspond to one another are shown with the same reference signs in all the Figures.

Figure 1:
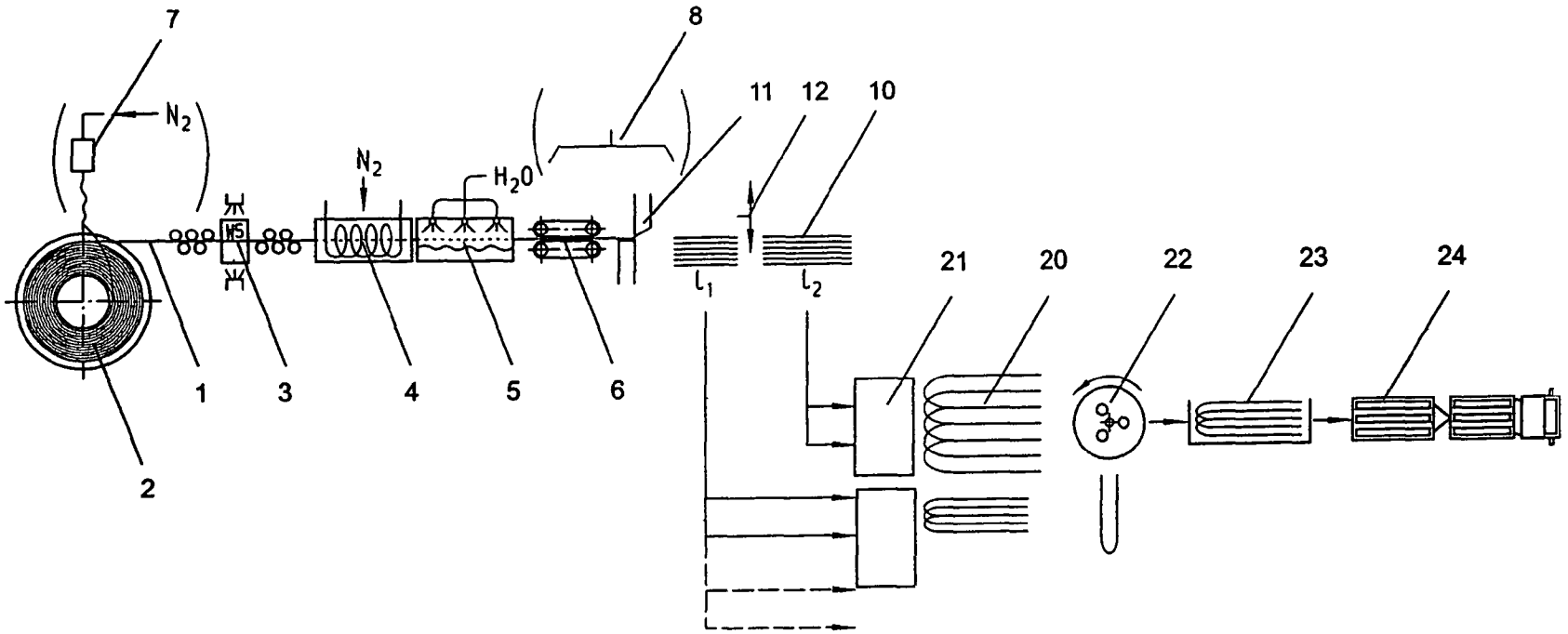
FIG. 1 shows a production line having an inert gas flushing unit.

In the embodiment according to FIG. 1, the production of tubes bent in the shape of a hairpin for lamellar heat exchangers is represented as the final step in the production of copper tubes. The drawn tube material 1, which, in the penultimate production step, has been deposited in a horizontal position in large round open-topped containers, is preferably conveyed directly from those basket winders 2 via a straightening and testing facility 3 to an inductive continuous annealing furnace 4 with a downstream cooling basin 5, and during that operation is flushed internally from an inert gas flushing unit 7 with nitrogen or nitrogen/hydrogen, which is removed again via a suction apparatus 8. In the recrystallised soft state, the drawn tube material 1 is conveyed by means of a transport unit 6 to a cutting unit 11 and directly cut to a desired length to form a separated tube portion 10 and, after a subsequent good/bad sorting operation 12, is further transported to the bending device 21.

Further processing to form hairpin tubes 20 having U-bend radii determined by the customer and parallel limb lengths is effected in this arrangement with straight tube portions 10 that have already been cut to the desired length. The soft tubes are again straightened on the bending device 21, bent to form hairpins and cut to a final length using a further cutting unit 22. The tubes bent in a U-shape are prepared for transport in a storage unit 23 and a packaging unit 24.

This procedure represents a solution which is geared to a high degree of internal cleanliness and which offers advantages after the tube production line for the manufacture of seamlessly drawn tubes and also for heat exchanger tubes welded with a longitudinal seam.

Figure 2:
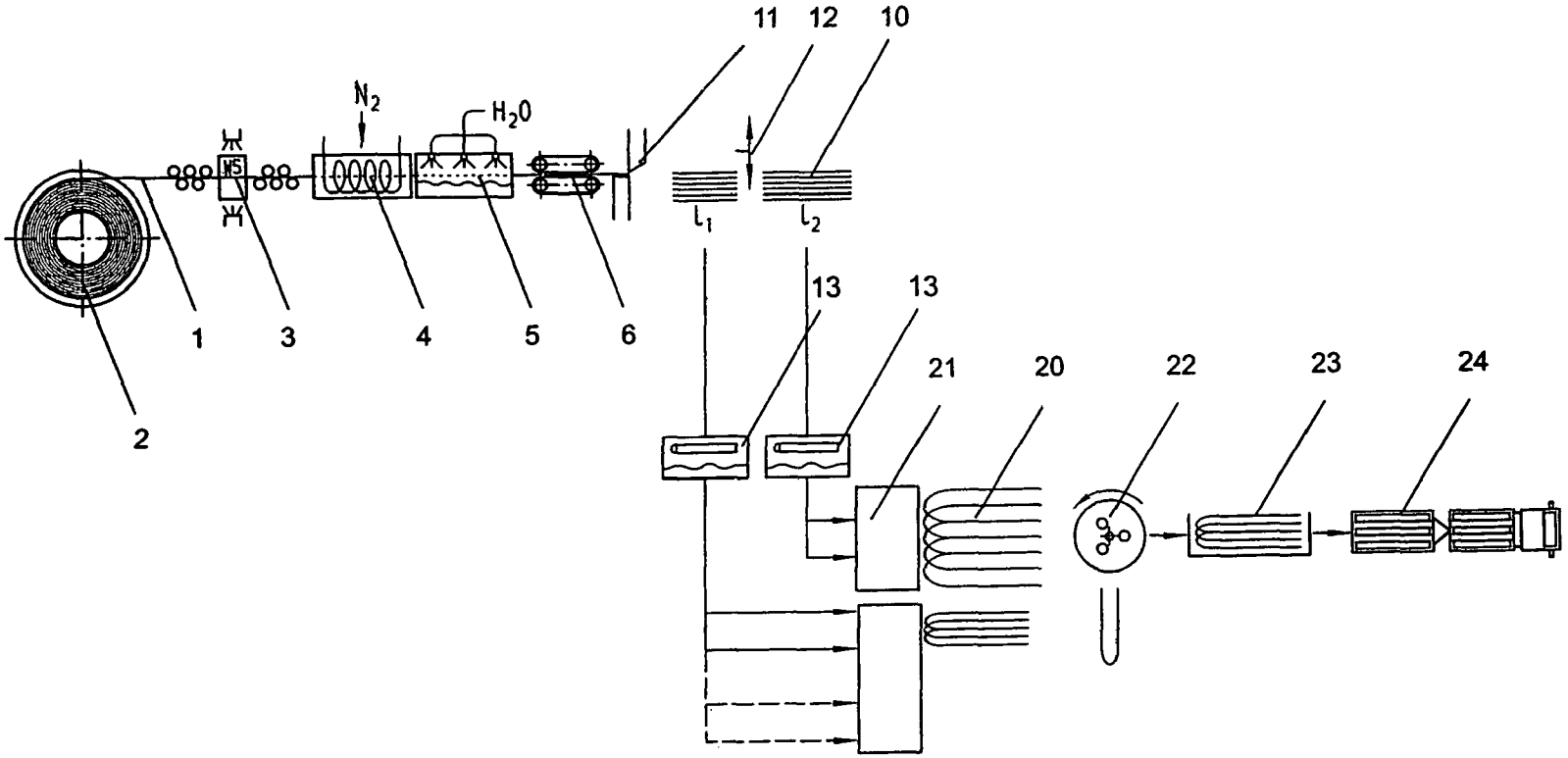
FIG. 2 shows a production line having an individual tube washing line.

The embodiment according to FIG. 2 represents a production line having an individual tube washing line 13 through which the separated tube portions 10 pass. In the case of the solution shown, the cleaning of the inner surfaces is therefore effected on the already soft cut-to-a desired length and sorted stretched tube portions 10 in a washing device arranged upstream of the hairpin bending machines 21. This process variant can guarantee that the inner tube surfaces have extremely high degrees of cleanliness corresponding to the outer surfaces.

Figure 3:
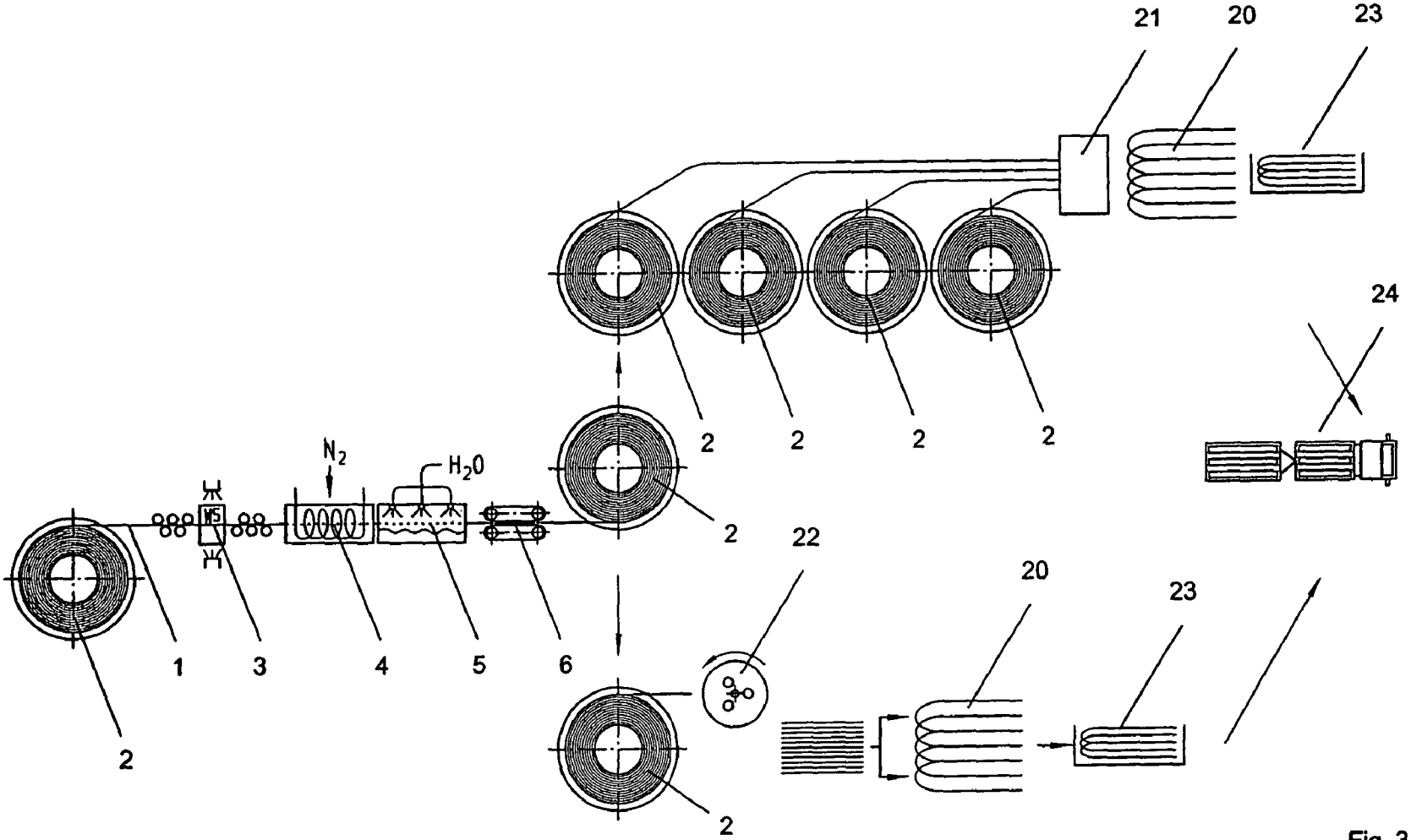
FIG. 3 shows a production line with a basket in basket-operation mode.

The embodiment according to FIG. 3 represents a production line with a basket in basket-operation mode. The bright-annealed tubes are likewise placed in the basket winder 2 in a soft and dry state. As also already stated above, it is known that there is hardly a metal surface that is so susceptible to scratching and damage as that of soft dry copper tubes. Therefore, in this processing step, the tubes are handled with special care by the controlled guiding of the windings into the basket, or a special basket construction. The lubrication of the outer surface with oil or the use of buffer/intermediate layers can also lead to scratch resistance.

The bending devices 21 used in this variant for U-shaped tubes permit the simultaneous bending of up to 8 hairpins or more at the same time. The machine pulls the particular required length of drawn tube material 1 from the coils. During the bending operation, the tubes are held. The bending operation is therefore a non-stationary process in relation to the tube movement. Bending mandrels are used in order to protect the tubes from collapsing. After the bending operation, the tubes ascertained to be defective are picked out manually or also automatically.

Figure 4:
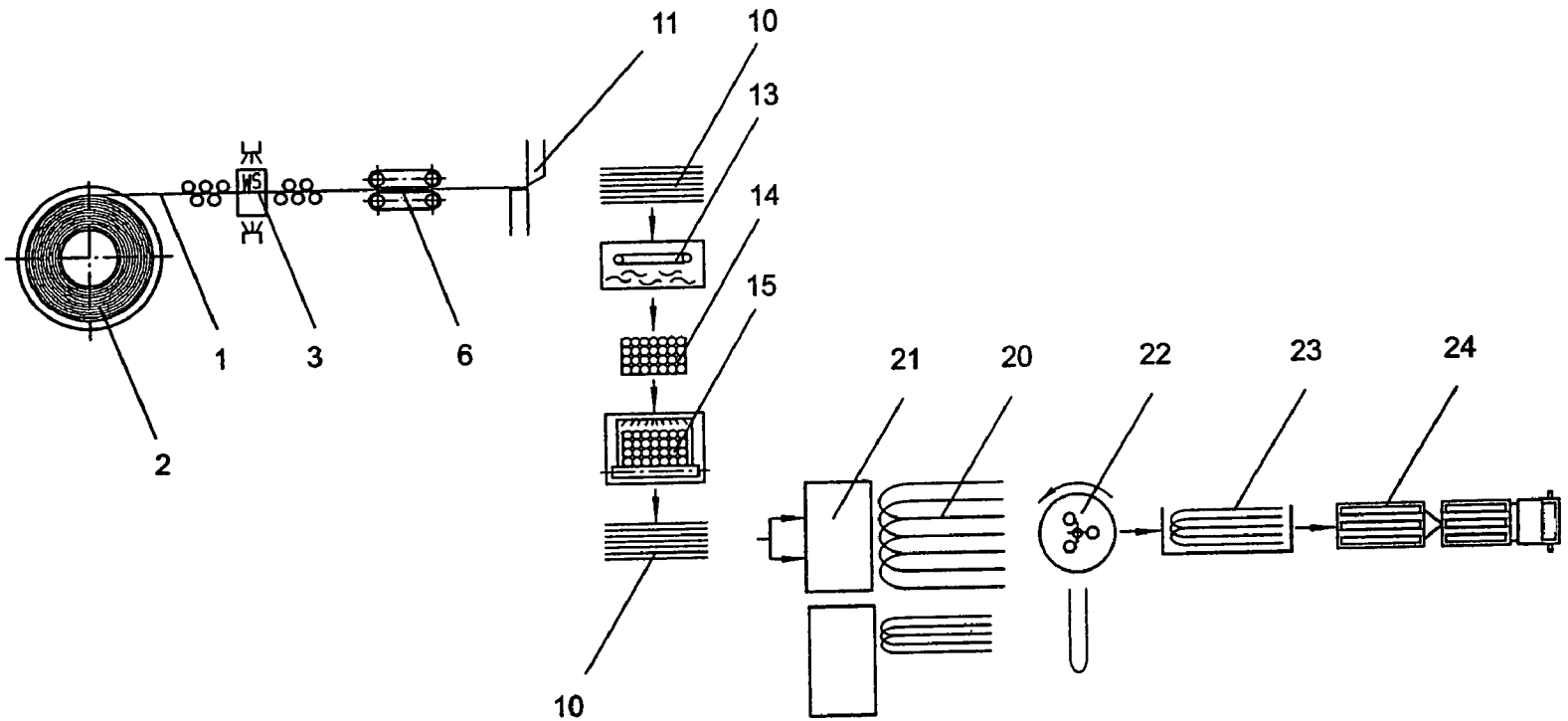
FIG. 4 shows a production line having an annealing unit for batch operation.

The embodiment according to FIG. 4 represents a production line having an annealing unit for batch operation. The separated tube portions 10 are conveyed to the cleaning apparatus 13 and subsequently deposited in a storage unit 14. Annealing is effected in batch operation in a radiation or convection furnace as the annealing unit 15 before the soft tube portions 10 are conveyed to the bending device 21.

Figure 5:
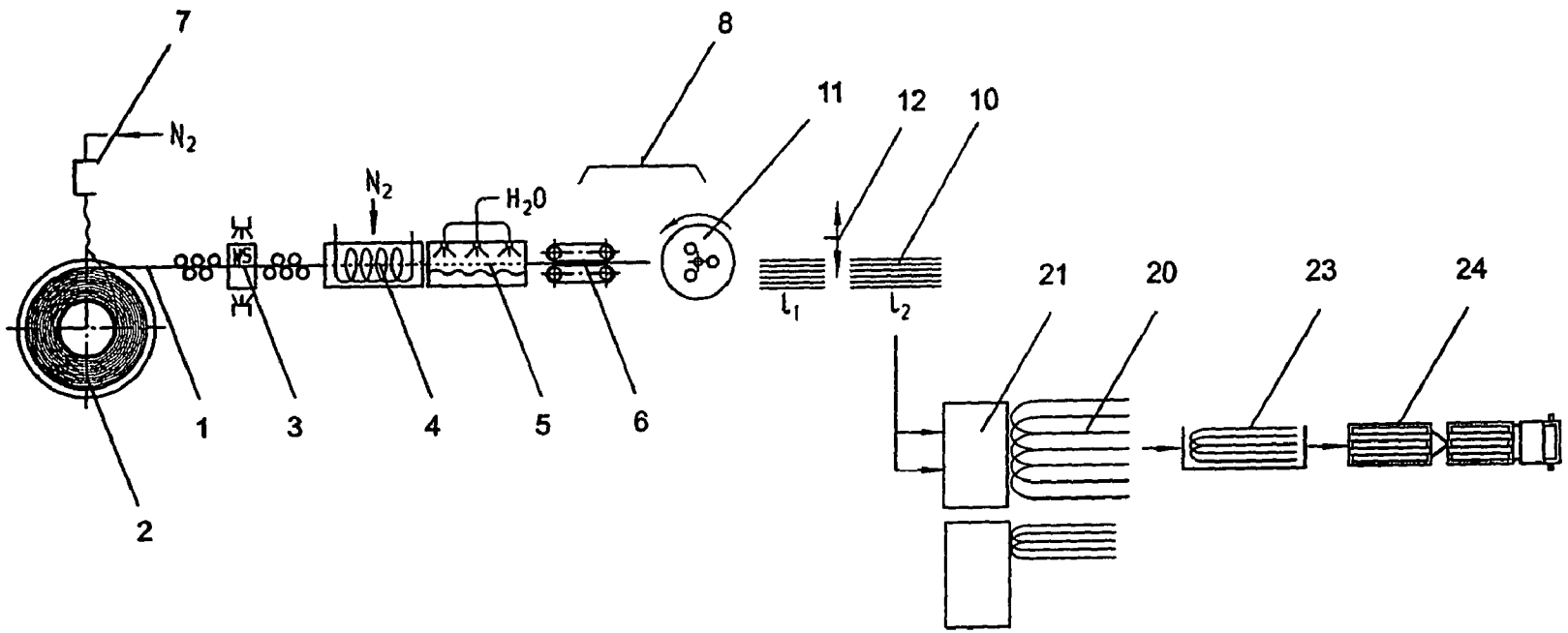
FIG. 5 shows a production line with different tube portion lengths.

The embodiment according to FIG. 5 largely corresponds to the production line shown in FIG. 1 with different tube portion lengths. In this embodiment, the individual tube lengths are cut using a rotating cutting unit 11 provided with multiple cutting heads.

Figure 6:
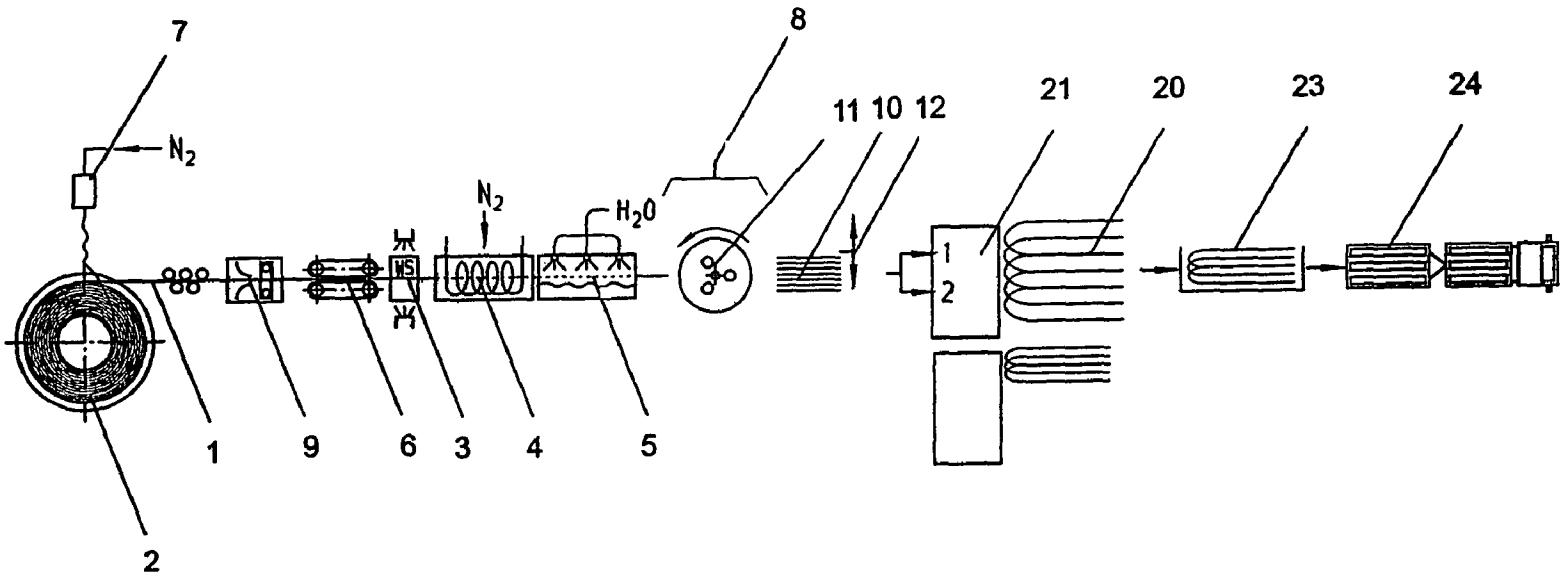
FIG. 6 shows a production line having a ribbing apparatus.

The embodiment according to FIG. 6 represents a production line having a ribbing apparatus, in the case of which the heat exchanger tubes are provided, for example, with internal ribbing within the line, a drilled through-hole through the axis of the mandrel rod, on which all the radially symmetrical ribbing tools are arranged, ensuring the passage of the flushing gas. During this operation, the rates of passage through the ribbing unit and the continuous annealing unit have to be adapted to one another in terms of automatic control engineering. The bright-annealed tubes are cut to the stretched hairpin lengths directly after the continuous annealing furnace and those lengths are conveyed to the bending machine in the form of individual lengths after a good/bad sorting operation 12. The advantage of this solution is the short tube length after the annealing section, as a result of which the reaction products freed from the flushing gas can be completely blown out and removed by suction, and this results in a high degree of internal cleanliness of the hairpins.

The invention claimed is:

1. A method of manufacturing lamellar U-shaped heat-exchanger tubes, comprising the steps of:

producing a drawn heat-exchanger tube material made of a nonferrous metal;

coiling the drawn heat-exchanger tube material horizontally in a round open-top container;

uncoiling the drawn heat-exchanger tube material from the container;

straightening the uncoiled drawn heat-exchanger tube material;

cutting the drawn heat exchanger tube material to form tube portions of a desired length;

forming a recrystallized state in the tube portions by annealing and subsequently cooling the tube portions; and bending the tube portions into a U-shape to form the lamellar U-shaped heat-exchanger tubes.

2. The method for the manufacture of heat-exchanger tubes according to claim 1, characterized in that the drawn tube portions are subjected to quality control.

3. The method for the manufacture of heat-exchanger tubes according to claim 1, characterized in that the drawn heat-exchanger tube material is flushed with inert gas.

4. Method for the manufacture of heat-exchanger tubes according to claim 3, characterized in that the inert gas flows counter to the direction in which the drawn heat exchanger tube material is uncoiled.

5. Method for the manufacture of heat-exchanger tubes according to claim 2, characterized in that, after the cutting to the desired length, the tube portions are subjected to internal and/or external cleaning.

* * * * *